United States Patent [19]

Nysen

[11] Patent Number: 4,724,443

[45] Date of Patent: Feb. 9, 1988

[54] PATCH ANTENNA WITH A STRIP LINE FEED ELEMENT

[75] Inventor: Paul A. Nysen, Sunnyvale, Calif.

[73] Assignee: X-Cyte, Inc., Mountain View, Calif.

[21] Appl. No.: 793,702

[22] Filed: Oct. 31, 1985

[51] Int. Cl.[4] ..... H01Q 1/38

[52] U.S. Cl. ..... 343/700 MS; 343/829; 343/830

[58] Field of Search ..... 343/700 MS, 829, 830

[56] References Cited

U.S. PATENT DOCUMENTS

| | | | |
|---|---|---|---|
| 3,665,480 | 5/1972 | Fassett | 343/754 |
| 4,241,352 | 12/1980 | Alspaugh et al. | 343/700 MS |
| 4,242,685 | 12/1980 | Sanford | 343/700 MS |
| 4,260,988 | 4/1981 | Yanagisawa et al. | 343/700 MS |
| 4,320,402 | 3/1982 | Bowen | 343/700 MS |
| 4,423,392 | 12/1983 | Wolfson | 333/116 |
| 4,477,813 | 10/1984 | Weiss | 343/700 MS |
| 4,554,549 | 11/1985 | Fassett et al. | 343/700 MS |
| 4,589,422 | 5/1986 | James et al. | 343/700 MS |

*Primary Examiner*—Robert E. Wise
*Assistant Examiner*—Doris J. Johnson
*Attorney, Agent, or Firm*—Karl F. Milde, Jr.

[57] ABSTRACT

A patch-type antenna is disclosed for radiating electromagnetic radiation in the microwave band. The antenna comprises first and second electrically conductive plates which are supported in spaced-apart parallel relationship. The first plate serves as a ground plane, whereas the second plate forms a patch antenna element. A feed element supplies RF energy to the patch antenna without physically contacting it. This feed element is formed by an elongate, electrically conductive strip line arranged between the two plates and extending from one edge of the second plate to an interior point thereof. The length of this feed element, in its longitudinal direction, is approximately equal to one fourth of the wavelength of the EMR radiation by the antenna at the radio frequency applied thereto.

7 Claims, 9 Drawing Figures

PATCH ANTENNA WITH A STRIP LINE FEED ELEMENT

BACKGROUND OF THE INVENTION

The present invention relates to an RF "patch" antenna employing a strip line feed element.

In many applications, small patch antennas are used to radiate microwave energy in a defined location. For example, such antennas are employed in passive and active radar systems to detect the presence, location and identity of objects within the radar beam. For example, such objects may carry active or passive transponders which are interrogated by the radar beam.

One such system which utilizes passive transponders is disclosed in the commonly-owned patent application Ser. No. 509,523, filed June 30, 1983, entitled "System for Interrogating a Passive Transponder Carrying Phase-Encoded Information".

A system of this kind is often installed on the wall of a building or housing structure at a point—near a door, gate, conveyor or railroad tracks—where the objects to be interrogated pass by. It is desirable that the antenna be easily adjustable upon installation, and also after installation, so that the radiated beam may be properly directed toward the object to be interrogated. It is also desirable to eliminate the requirement for direct electrical connection to antenna parts that need to be selected, during the system installation, or subsequently changed in the field.

SUMMARY OF THE INVENTION

It therefore an object of the present invention to provide a patch antenna which may be constructed with any shape, size and orientation, so as to radiate an energy beam that meets the requirements of a particular application.

It is a further object of the present invention to provide a patch antenna which may be installed on a wall or other structure with a minimum of difficulty.

It is a further object of the present invention to provide a patch antenna which is excited without the physical connection thereto of any electric wires or the like.

These objects, as well as further objects which will become apparent from the discussion that follows, are achieved, according to the present invention, by constructing the antenna of the following elements:

(a) a first electrically conductive plane which serves as a ground plane;

(b) a second electrically conductive plate forming the patch antenna element and supported in a spaced-apart, substantially parallel relationship to the first plate;

(c) a first lead, connected to the first plate, for electrically connecting the first plate to a ground potential;

(d) at least one elongate and electrically conductive strip line feed element arranged between the aforementioned first and second plates and extending from its first end at one edge of the second plate to its second end at an interior point between the two plates; and (e) a second lead connected to the first end of the feed element for electrically coupling the feed element to a radio frequency source.

According to the invention, therefore, the strip line feed element serves to excite the patch antenna plate without physically contacting this plate. This is accomplished by making the length of the feed element in its longitudinal direction in the range of $\lambda/8$ to $3\ \lambda/8$, where $\lambda$ is the wavelength of the electromagnetic radiation produced by the antenna at the radio frequency applied thereto.

The feed element thus effectively becomes a so-called "quarter wavelength line" with its attendant, well-known properties. Such a line will appear to provide a short circuit between its first end, connected to the RF source, and the second plate forming the patch antenna element.

Since the second plate which serves as the patch antenna is not physically contacted, the requirements for its installation in a wall or other structure are extremely flexible. For example, this plate may be separately attached to a wall by tape or adhesive. In so doing, the plate may be sized and oriented to produce the desired orientation and polarization (circuit or linear) of the beam. The first plate which serves as the ground plane, the strip line feed element and the associated ground and RF leads may then be installed as a unit in alignment with the patch antenna plate.

For a full understanding of the present invention, reference should now be made to the following detailed description of the preferred embodiments of the invention and to the accompanying drawings.

DESCRIPTION OF THE PREFERRED EMBODIMENTS

Figure 1:
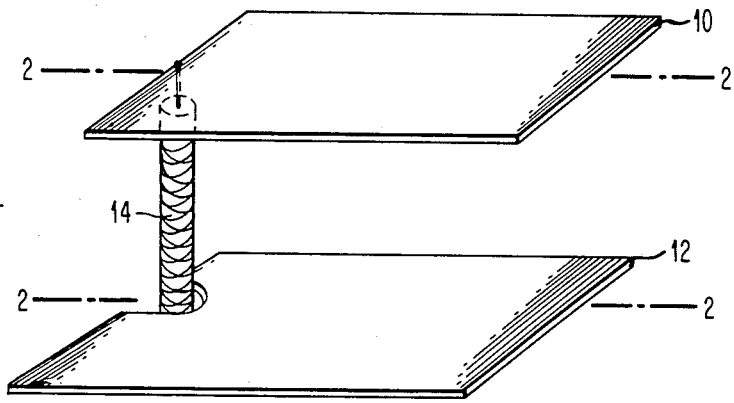
PRIOR ART FIG. 1
FIG. 1 is an assembly diagram, in perspective, of a patch antenna system of the type known in the prior art.

The preferred embodiments of the present invention will now be described with reference to FIGS. 1–9 of the drawings. Identical elements in the various figures are designated with the same reference numerals.

Figure 2:
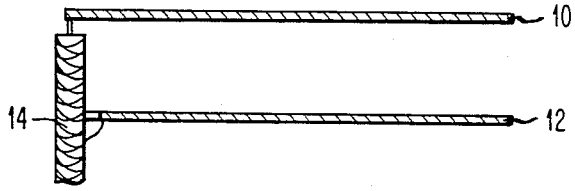
PRIOR ART FIG. 2
FIG. 2 is a cross-sectional diagram of the antenna of FIG. 1 taken along the line 2—2 in FIG. 1.

Referring to FIGS. 1 and 2, there is shown, respectively, a perspective and sectional view of one embodiment of a known patch antenna comprising a front conducting plate 10, which serves to radiate electromagnetic energy, and a back conducting plate 12 which is held in parallel relationship to the front plate by non-conductive structural elements (not shown). The region between the parallel plates 10 and 12 may be filled with a solid dielectric material, or it may be left open as shown in FIGS. 1 and 2, so that the dielectric is air. The distance between the plates depends upon the dielectric and the frequency of the transmitted energy. In the case of air as a dielectric and a frequency of about 915 MHz, the plates should be spaced no more than about one inch apart.

Physical electrical contact is made with both the front plate 10 and the back plate 12 by means of a shielded coaxial cable 14. The inner lead of the shielded cable, which supplies the RF energy, is connected to the front plate 10 whereas the outer (ground) shield is connected to the back plate 12, for example by soldering the leads directly to the respective plates.

While structures of the type shown in FIGS. 1 and 2 operate effectively to radiate energy in the microwave range of frequencies, they do not lend themselves to simple and convenient modification to select the direction, size, shape, orientation and polarization of the energy beam. Such a design of the beam is required, for example, in both active and passive radar systems which monitor the presence, identity and location of nearby transponder-carrying objects. As noted above, a system of this type is disclosed in the commonly-owned U.S. patent application Ser. No. 509,523, filed June 30, 1983, for "System For Interrogating A Passive Transponder Carrying Phase-Encoded Information".

Figure 3:
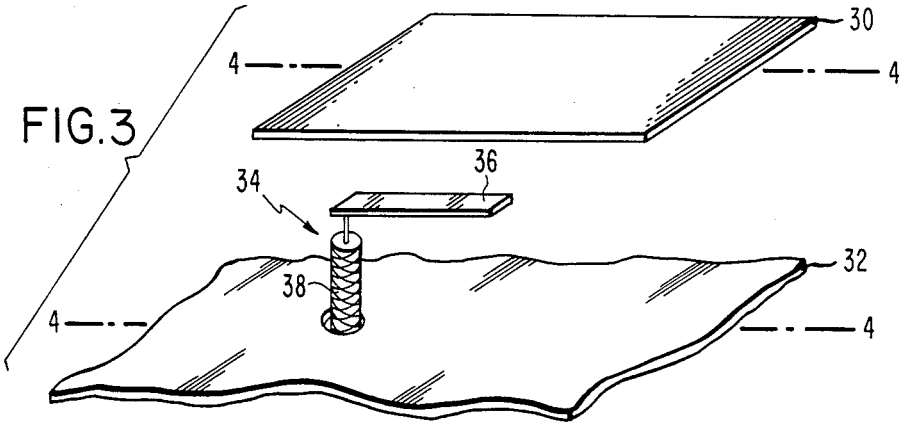
FIG. 3 is a perspective view of a patch antenna according to a first preferred embodiment of the present invention.
Figure 4:
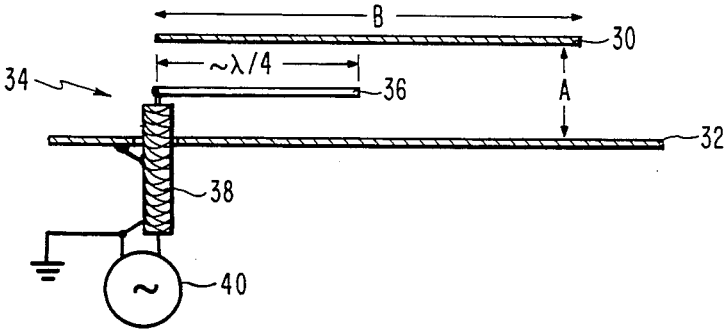
FIG. 4 is a cross-sectional diagram of the patch antenna of FIG. 3, taken along line 4—4 of FIG. 3.

FIGS. 3 and 4 show a first preferred embodiment of the invention whereby the front, radiating plate or "patch" is physically free or unattached from the feed line which supplies RF energy thereto. In this case, the antenna comprises a front radiating plate 30, a back or ground plate 32, which may have larger dimensions than the front plate 30, and a feed element 34. The feed element 34 comprises an elongate, electrically conductive strip line 36 which is connected at one end to the central lead of a shielded, coaxial cable 38. The shield of coaxial cable 38 is connected to the ground plate 32. A source 40 supplies RF energy to the central and ground leads of the cable 38.

The strip line feed element 36 serves as a coupling probe to couple RF energy to the antenna plate 30. To this end, the length of the feed element is set equal to approximately one quarter the wavelength λ of the electromagnetic radiation to be radiated by the antenna. More particularly, the length of this feed element should be in the range of λ/8 to 3 λ/8. For example, at radar frequencies in the 915 MHz band, the feed element may have a length of approximately three inches. While the width of the feed element is not critical, this width affects the antenna impedance and should be substantially less than the feed element length. A feed element one half inch wide will serve in most applications.

Since the feed element is not terminated at its free end and thus forms an open circuit, its opposite end, which is connected to the center feed line of the cable 38, will appear to be shorted to the adjacent region of the patch antenna plate 30. This feed element therefore serves to effectively couple the feed line directly to the plate 30 (although there is no actual, physical connection). In particular, the structure according to the invention serves to excite the antenna plate 30 without physical connection thereto.

As shown in FIG. 4, the distance A of the patch antenna plate 30 from the ground plane 32 may be relatively large. Provided that this distance A is less than one quarter wavelength (λ) increasing the distance A will increase the bandwidth of the antenna. The distance A is optimally approximately 10–20% of the distance B, the length of the patch antenna 30, for maximum bandwidth. The distance A may be made as low as 2–3% of the distance B for narrower bandwidth.

The size and shape of the antenna plate 30 may be selected, using well-known patch antenna theory, to create the desired beam. In the embodiment shown in FIGS. 3 and 4, the plate 30 is square with its width dimension B equal to approximately one half the wavelength (λ) at the frequency of operation. The antenna plate 30 can also be circular, elliptical, rectangular, trapazoidal, a parallelogram or some other shape depending upon the desired size, shape, orientation and polarization of the radiated beam.

Since the thickness of the antenna plate 30 is not critical, the plate 30 can be made of stamped conductive foil (e.g., aluminum or copper) or may be formed by depositing a conductive layer on a non-conductive substrate.

Figure 5:
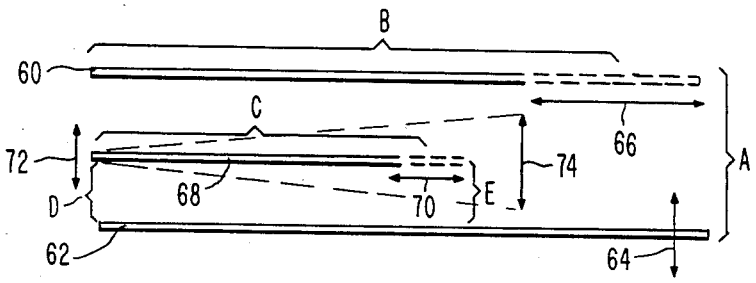
FIG. 5 is a representational diagram of a patch antenna according to the invention showing adjustments that can be made for tuning the antenna.

FIG. 5 illustrates how the various elements of the antenna may be adjusted to tune the antenna. As noted above, the distance A between the two plates 60 and 62 may be adjusted, as indicated by the arrows 64, to select the bandwidth of the antenna. The length dimension B of the antenna plate 60 can be adjusted, as indicated by the arrows 66, and all other dimensions of this antenna plate may be adjusted to select the size, shape, orientation and polarization of the radiated beam. The length C of the feed element 68 may be adjusted as indicated by the arrows 70 to obtain maximum coupling between the feed element 68 and the antenna plate 60. Finally, the distances D and E of the first and second ends of the feed element from the ground plate 62 may be adjusted, as indicated by the arrows 72 and 74, respectively, to control the impedance of the antenna. In all cases, the dimensions of the ground plate 62 should be at least as large as those of the antenna plate 60.

Figure 6:
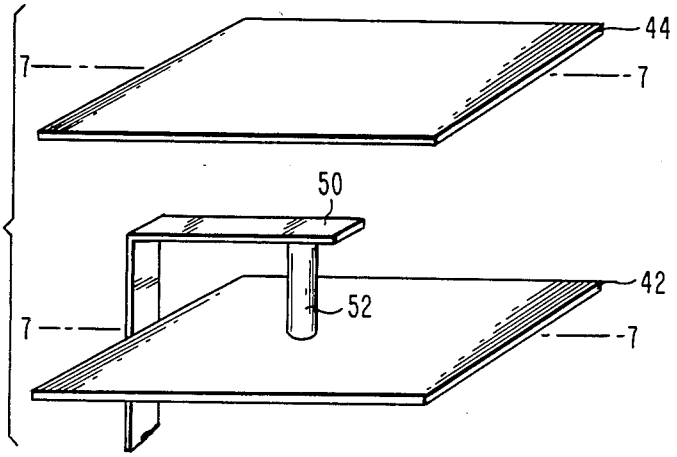
FIG. 6 is a perspective view of a patch antenna according to a second preferred embodiment of the present invention.
Figure 7:
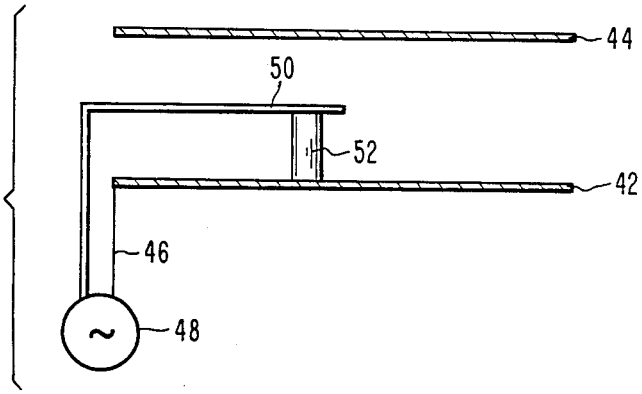
FIG. 7 is a cross-sectional diagram of the patch antenna of FIG. 6, taken along the line 7—7 of FIG. 6.
Figure 8:
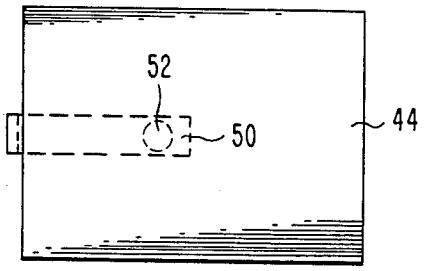
FIG. 8 is a plan view of the patch antenna of FIG. 6.

In a preferred embodiment of the invention, the following dimensions have been selected for radiating RF energy at 915 MHz:

Patch antenna plate (rectangular):
Length B32 5.4 inches
Width =5.25 inches
Distance between plates:
A=½ inch
Feed element:
Length C=3 inches
Width=½ inch
Distance D of first end from ground plane =0.3 inches
Distance E of second end from ground plane =0.4 inches FIGS. 6, 7 and 8 illustrate an alternative embodiment of a patch antenna according to the invention. This embodiment comprises an electrically conductive first plate 42, which serves as a ground plane and a second electrically conductive plate 44, which serves as a patch antenna. The first and second plates are supported in a spaced-apart parallel relationship in the manner described above in connection with the embodiment of FIGS. 3 and 4.

A first lead 46 connects the first plate 42 to the ground terminal of an RF source 48. An elongate, electrically conductive strip line feed element 50 is arranged substantially equidistantly between, and extends substantially parallel to, the first and second plates 42 and 44, respectively. This strip line feed element is bent at one end at a 90 degree angle and extends downward as an electrical lead past the plate 42 to the RF source 48.

As explained above in connection with the embodiment of FIGS. 3 and 4, the length of the strip line feed element 50 in its longitudinal direction is made approximately equal to one fourth the wavelength λ of the electromagnetic radiation generated by the antenna at the radio frequency applied thereto (or, more specifically, in the range of λ/8 to 3 λ/8). This causes the bent over end of the feed element 50 to appear as a short circuit with respect to the adjacent plate 44 thereby electrically exciting this plate so that it radiates as a patch antenna.

A plastic standoff element 52 is provided between the feed element 50 and the first plate 42 which serves as a ground plane to maintain the element 50 in substantially parallel relationship and prevent possible vibration.

Figure 9:
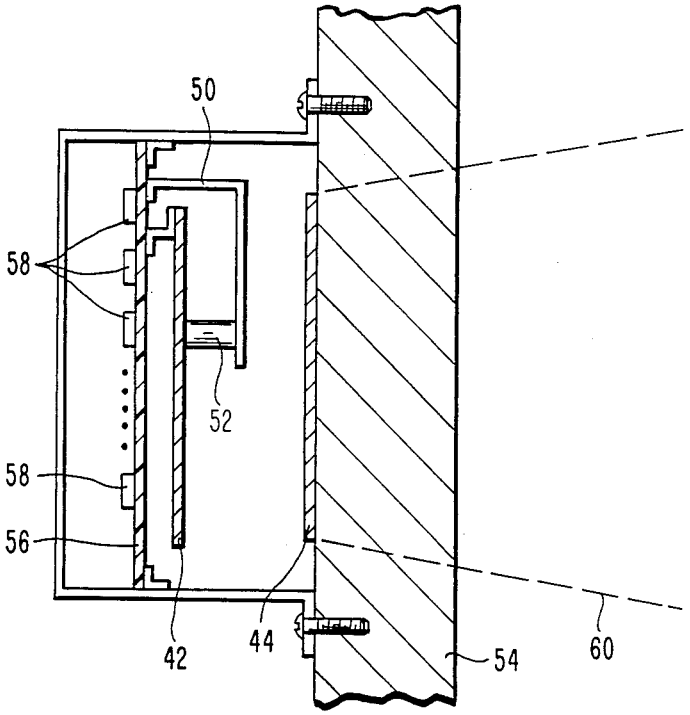
FIG. 9 is a cross-sectional view of a patch antenna according to the present invention installed in a building wall.

FIG. 9 shows how the antenna arrangement according to the invention may be installed in a wall 54. In this case, the patch antenna plate 44 is directly mounted on the wall, and all the other parts, including the ground plate 42 and the feed element 50, are mounted as a unit behind the plate 44. The antenna is driven by an RF source mounted on a circuit board 56 containing circuit elements 58.

Since no physical contact is required between the feed element 50 and the patch antenna plate 44, the plate 44 may be sized and oriented, as desired, to produce an energy beam 60 of the desired direction, size, shape orientation and polarization.

There has been shown and describede a novel patch antenna arrangement which fulfills all the objects and advantages sought therefor. Many changes, modifications, variations and other uses and applications of the subject invention will, however, become apparent to those skilled in the art after considering this specification and the accompanying drawings which discloses preferred embodiments thereof. All such changes, modifications, variations and other uses and applications which do not depart from the spirit and scope of the invention are deemed to be covered by the invention which is limited only by the claims which follow.

What is claimed is:

1. An RF antenna for radiating electromagnetic radiation ("EMR") comprising:

(a) a first electrically conductive plate, which serves as a ground plane;

(b) a second electrically conductive plate, which serves as a patch antenna element, said second plate being supported in spaced-apart, substantially parallel relationship to said first plate;

(c) a first lead, connected to one of said first and said second plates, for electrically connecting said one plate to a ground potential;

(d) at least one elongate, electrically conductive strip-line feed element arranged between said first and second plates and extending from a first end at one edge of said second plate to a second end at an interior point thereof, said feed element having a length in its longitudinal direction in the range of λ/8 to 3 λ/8, where λ is the wavelength of EMR at the radio frequency of operation; and (e) a second lead, directly connected to said first end of said feed element for electrically coupling radio frequency energy into or out of feed element;

whereby said feed element is electrically coupled to one of said first and second plates at said radio frequency to radiate or receive EMR.

2. The antenna defined in claim 1, wherein said length of said feed element is substantially equal to λ/4.

3. The antenna defined in claim 1, wherein said first plate is at least as large as said second plate.

4. The antenna defined in claim 1, wherein said second plate is rectangular in shape.

5. The antenna defined in claim 1, wherein said feed element extends toward the center of said second plate from a point near the edge of said second plate.

6. The antenna defined in claim 1, further comprising a non-conducting standoff element arranged between said feed element and said first plate at said second end of said feed element.

7. The antenna defined in claim 1, wherein said feed element is arranged substantially equidistantly between, and extends substantially parallel to, said first and said second plates.

* * * * *